US005877440A

United States Patent [19]

Chaffee et al.

[11] Patent Number: 5,877,440

[45] **Date of Patent: *Mar. 2, 1999**

[54] ADJUSTABLE SOUND ENHANCING MUFFING DEVICE FOR PERCUSSION INSTRUMENT BACKGROUND OF THE INVENTION

[76] Inventors: Gary Chaffee, 16 White Oak Rd., Roxbury; Wolfgang Ruckner, 227 Temple St., West Roxbury, both of Mass. 02132

[ * ] Notice: This patent issued on a continued prosecution application filed under 37 CFR 1.53(d), and is subject to the twenty year patent term provisions of 35 U.S.C. 154(a)(2).

[21] Appl. No.: 641,622

[22] Filed: May 2, 1996

[51] Int. Cl.[6] ..... G10D 13/02

[52] U.S. Cl. ..... 84/411 M; 84/421; 84/453

[58] Field of Search ..... 84/411 M, 421, 84/453

[56] References Cited

U.S. PATENT DOCUMENTS

| | | | |
|---|---|---|---|
| 1,892,223 | 12/1932 | Sansone et al. | 84/411 M |
| 2,078,004 | 4/1937 | Lebow | 84/411 M |
| 2,499,616 | 3/1950 | Walberg | 84/411 M |
| 2,565,225 | 8/1951 | Gladstone | 84/411 M |
| 2,572,504 | 10/1951 | Meriwether | 84/411 M |
| 2,893,283 | 7/1959 | Ippolito | 84/411 M |
| 3,433,115 | 3/1969 | Kjelstrom | 84/411 M |
| 3,453,924 | 7/1969 | Glick et al. | 84/411 M |
| 3,951,032 | 4/1976 | LaPorta et al. | 84/411 M |
| 4,102,235 | 7/1978 | LeMasters | 84/411 M |
| 4,325,281 | 4/1982 | Hardy | 84/411 M |
| 4,338,850 | 7/1982 | Payson | 84/411 M |
| 4,567,807 | 2/1986 | Robinson | 84/411 M |
| 4,745,839 | 5/1988 | Peraino | 84/411 M |
| 4,805,514 | 2/1989 | Billings | 84/411 M |
| 4,899,635 | 2/1990 | Santangelo | 84/411 M |
| 5,107,741 | 4/1992 | Beals et al. | 84/411 M |
| 5,159,139 | 10/1992 | Beals et al. | 84/411 M |
| 5,404,784 | 4/1995 | Steenbock | 84/411 M |

FOREIGN PATENT DOCUMENTS

| | | | |
|---|---|---|---|
| 0074017 | 7/1978 | Japan | 84/411 M |

*Primary Examiner*—Jonathan Wysocki
*Assistant Examiner*—Kim Lockett
*Attorney, Agent, or Firm*—Thomas R. Vigil

[57] ABSTRACT

An adjustable sound enhancing muffler device for a percussion instrument includes a first arm member having structure to be connected to a percussion instrument which is cooperative with a second arm member having a plurality of pad members having sound-muffling characteristics. The second arm member is selectively and removably connected to the first arm member at a point adjacent a slot of the first arm member to provide for a variety of radial and axial positioning of the second arm member with respect to the first arm member. The plurality of pad members may be maintained in a constant set contact with a membrane of a percussion instrument at a selected tension by means of a threaded screw cooperating with a tension spring.

17 Claims, 8 Drawing Sheets

ADJUSTABLE SOUND ENHANCING MUFFING DEVICE FOR PERCUSSION INSTRUMENT BACKGROUND OF THE INVENTION

BACKGROUND OF THE INVENTION

1. Field of the Invention

This invention relates to musical drum instruments, and more particularly concerns a device for external adjustable attachment to a drum head that enhances the quality of the sound produced by the drum.

2. Description of the Related Art Including Information Disclosed Under 37 CFR § 1.97–1.99

Musical drums generally have a circular cylindrical side wall shell supporting an upper or attack head and an opposed parallel lower or resonating head. The heads each consist of an outer rim associated with the shell and a drum head membrane tautly stretched upon the rim. A plurality of tensioning devices are disposed upon the exterior surface of the shell to provide appropriate tension to the membranes. The attack membrane usually has a preferred attack area centered therein.

Drum heads, particularly those of the more recent plastic and other synthetic types, often exhibit a total phenonemon known as "drum head ring", or more simply, ringing, which is characterized by distorted upper harmonic tonal overrings that vary in pitch as successive impacts are applied to the attack drum head, and when electric sound amplification systems are used to increase the volume of the drum, drum head ring becomes significantly more noticeable.

Drum head ring presented a minor problem when drum membranes were made principally of natural products, such as cat skin or other "gut" type materials. The natural product drum membranes exhibited only low levels of drum head ring, often not noticeable to the average listener. However, with the increased popularity of synthetic drum membranes, ringing has presented a more severe problem. The synthetic membranes produce a more distortable ring of louder volume than do natural product membranes; thus, even a musically untrained listener may notice the distorted tone quality of the synthetic membrane. When electronic amplification is used to increase the volume of the drum sound, ringing becomes even more noticeable. As a result of some very significant advantages of synthetic membranes over natural product membranes, which make the use of synthetic membranes popular, it is highly desirable to minimize, suppress and muffle unwanted overtones and vibrations without detracting from the sound of the primary fundamental desirable tones. This is particularly true in the advent of digital recording and playback and its corresponding increasingly high quality demands placed upon musical recordings and performances.

In the past, articles such as ordinary blankets, pillows, and other available objects having the ability to absorb sound have been inserted internal to the drum shell and against the drum membrane. Such usage of rugs or pillows, or the like, is unsightly especially when transparent drum membranes are used and traveling bands are inconvenienced by the need to carry the large bulky items. To some extent, pillows, rugs, or the like placed internal of the drum shell also retard the desired drum sound and projection, in addition to retarding ringing. Thus, the desired tone and volume of the drum may be adversely affected. Still further, use of pillows or rugs and the like internal of a drum may be impractical for a marching drummer. Also, the use of rugs or pillows, or the like, may adversely affect the "feel" of the drum thereby detracting from the performance of the drummer or may fail to provide a uniform and/or consistent tension against the drum membrane.

U.S. Pat. Nos. 2,499,616, 2,572,504, 3,951,032, and 5,107,741 are exemplary of different configurations and forms of drum mutes internal to a drum membrane surface for the purpose of reducing drum head ring which are internal to a drum head or membrane. Although such configurations and forms of drum mutes are directed to the reduction of drum head ring, their internal nature may be undesirable in several respects in that internal placement may establish the drum mute in a set non-adjustable position, access to the drum mute may be blocked by its internal nature, and drums without an internal drum muting configuration may not conveniently be retrofitted to include such an internal drum mute feature. Additionally, when a muffling device bears against the drum head or membrane, the pitch of the sound emanating from the drum is often changed depending not only upon the amount of pressure with which the muffling device bears against the drum head or membrane, but also by the number and/or location of the muffling device. Still further, internal muffling devices may be composed of several mechanically connected metal parts, which tend to rattle and loosen, adding extraneous noise.

In the past, attempts have been made to mute or muffle a drum by the drummer laying something on the drum head. Often, such an expedient is directed to solving the problem of drum head ring, yet the solution is not consistent, may be unattractive in a concert setting, and since the drum head necessarily vibrates during a performance, something simply lying on the drum head will move around on the drum head and may interfere with the play of the drum. Thus, attempts have been made to provide an external drum mute to a drum head or membrane such as the differing configuration and forms of drum mutes disclosed in U.S. Pat. Nos. 2,565,225, 4,567,807, 4,899,635, and 5,404,784.

SUMMARY OF THE INVENTION

In accordance with the present invention, there is provided an adjustable sound enhancing muffler device for reducing undesirable overtones and ringing when a percussion instrument to which the device is affixed is struck, the device comprising:

a first arm member having a distal end and a proximal end and having a slot extending longitudinally between the distal end and a proximal end, means for selectively and removably connecting the first arm member to a percussion instrument, a second arm member having a plurality of pad members connected to the second arm member, each pad member having sound-muffling characteristics, means for selectively and removably connecting the second arm member to the first arm member at a point adjacent the slot of the first arm member, and tensioning means to place the plurality of pad members in contact with a membrane of the percussion instrument.

The present invention is directed to a uniquely constructed externally mounted adjustable drum muffler sound enhancing device which provides a plurality of contact points (pad members) against a drum head or membrane which may be selectively and removably applied to differing positions on the membrane to vary the sound characteristics of the drum. Additionally, the contact of the pad members against the drum head or membrane may be adjusted in its tension and set for a selected consistent tension by tensioning means which also contribute to the weight of the plurality of pad members upon the membrane to thereby contribute to a reduction in the vibratory motion of the membrane and minimize or prevent any shifting movement of the pad members relative the membrane. The device has means for removably attaching the same to an external rim or shell of a drum along the entire diameter of the drum rim providing additional potential points of contact of the pad members against the drum head or membrane. Such means for attachment allows the device to retrofit and be independently applied to pre-existing drums in a minimally intrusive manner so as to allow drum covers to enclose the device and drum combination during transportation of the same. Further, the device has means for selectively and removably connecting the second arm member to the first arm member at any of the points adjacent the slot of the first arm member, thereby allowing selection of a variety of radial and axial positioning of the second arm member, and hence the pad members, relative the drum membrane. Still further, the plurality of pad members each contain dampening material as a component of the pad member which can be removed and interchanged by fastening means to provide differing shapes of pad members, pad members of differing dampening material composition, or to replace worn pad members.

DESCRIPTION OF THE PREFERRED EMBODIMENTS

Figure 4:
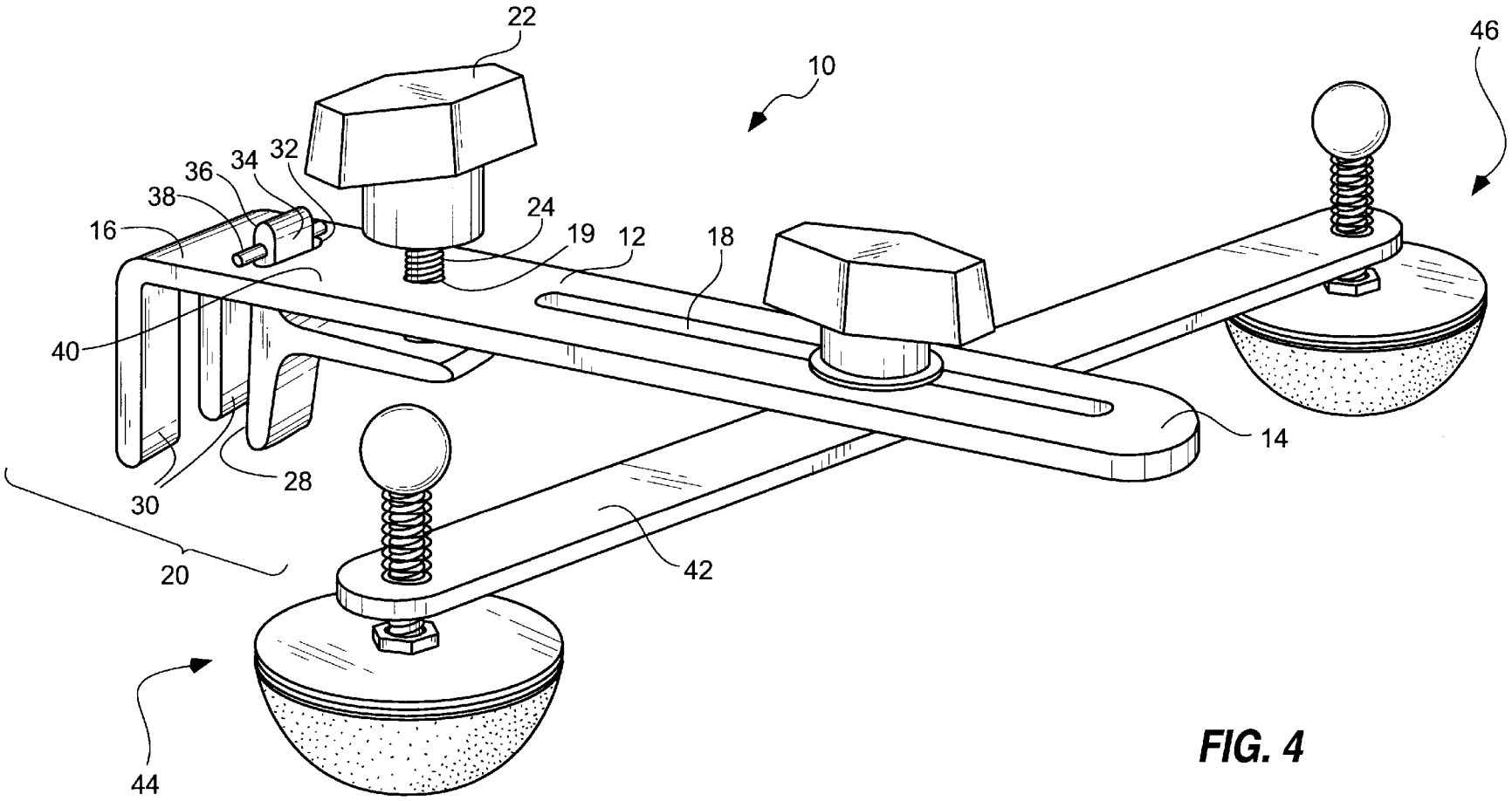
FIG. 4 is a perspective view of an adjustable sound enhancing muffler device according to the present invention.

Referring now more particularly to the drawings, and to that embodiment of the invention herein presented by way of illustration, FIG. 4 shows an adjustable drum muffler sound enhancing device 10 made in accordance with the present invention.

Figure 1:
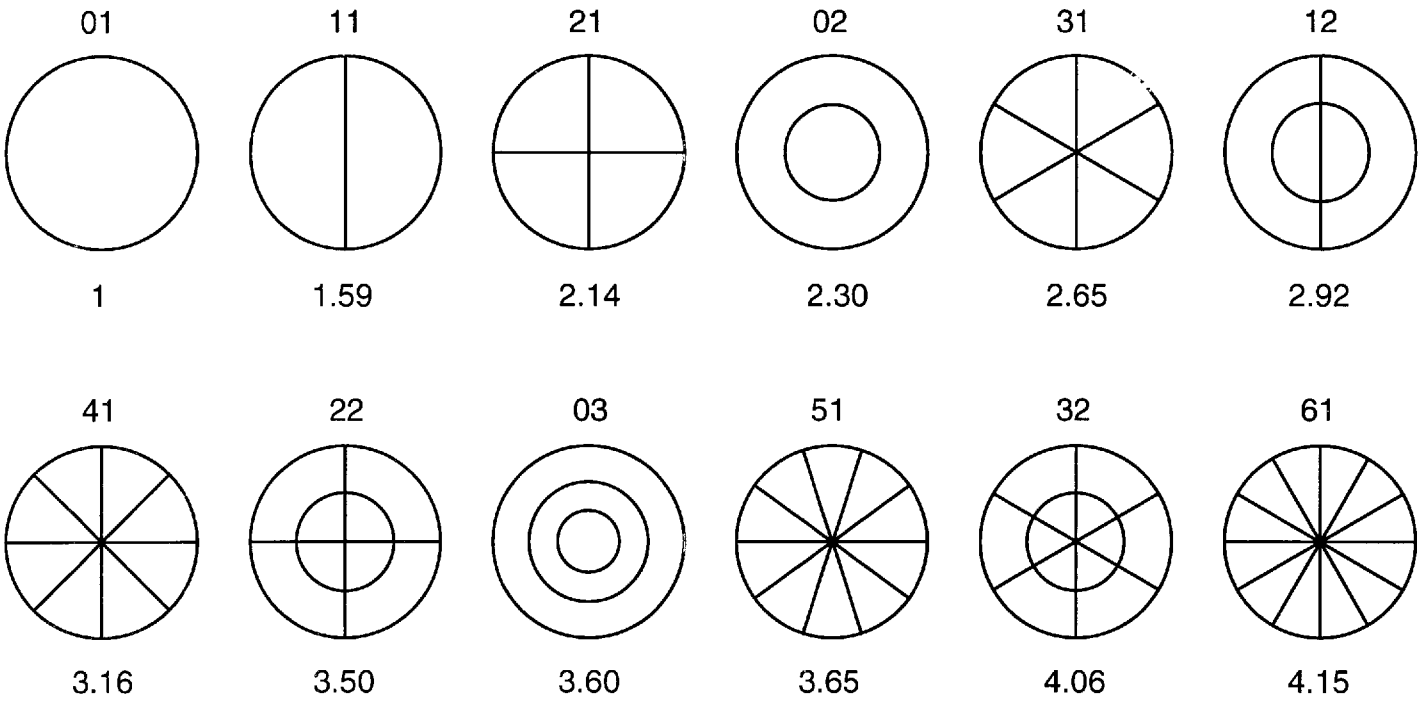
FIG. 1 is a diagrammatic illustration of twelve normal modes of vibration of a circular percussion instrument membrane.

It should first be understood that the object of reducing or eliminating the undesirable drum head ringing, or acoustical overtones, in a drum, percussion instrument, or the like involving a muting point of contact against the drum head or membrane relates not only to muting or softening of the undesirable ringing of a drum but also to the overall desired musical sound of the drum. In this regard, FIG. 1 depicts twelve normal modes of vibration of an ideal circular rim head or membrane wherein the linear and circular nodes are indicated by line and circle respectively, and a customary mode designation number is given above each circular membrane illustration of the twelve normal modes wherein the first leftmost number gives the number of linear (lineal across diameter) nodes, and the second rightmost number indicates the circular nodes, including at least one at the edge of each drum membrane. The number below each mode diagram gives the frequency of that mode compared to the fundamental (01) mode. For example, the (31) mode has three linear nodes and one circular node (around the edge) and vibrates at a frequency of 2.65 times that of the lowest mode (01). The actual vibration of a drum head is a superposition of all the normal modes of vibration, as well as dozens of even higher frequency modes of vibration. The spectrum of sound made by the drum is a superposition of the sounds of these individual modes of vibration and the overall character of this sound depends on the relative intensities and durations.

Figure 2:
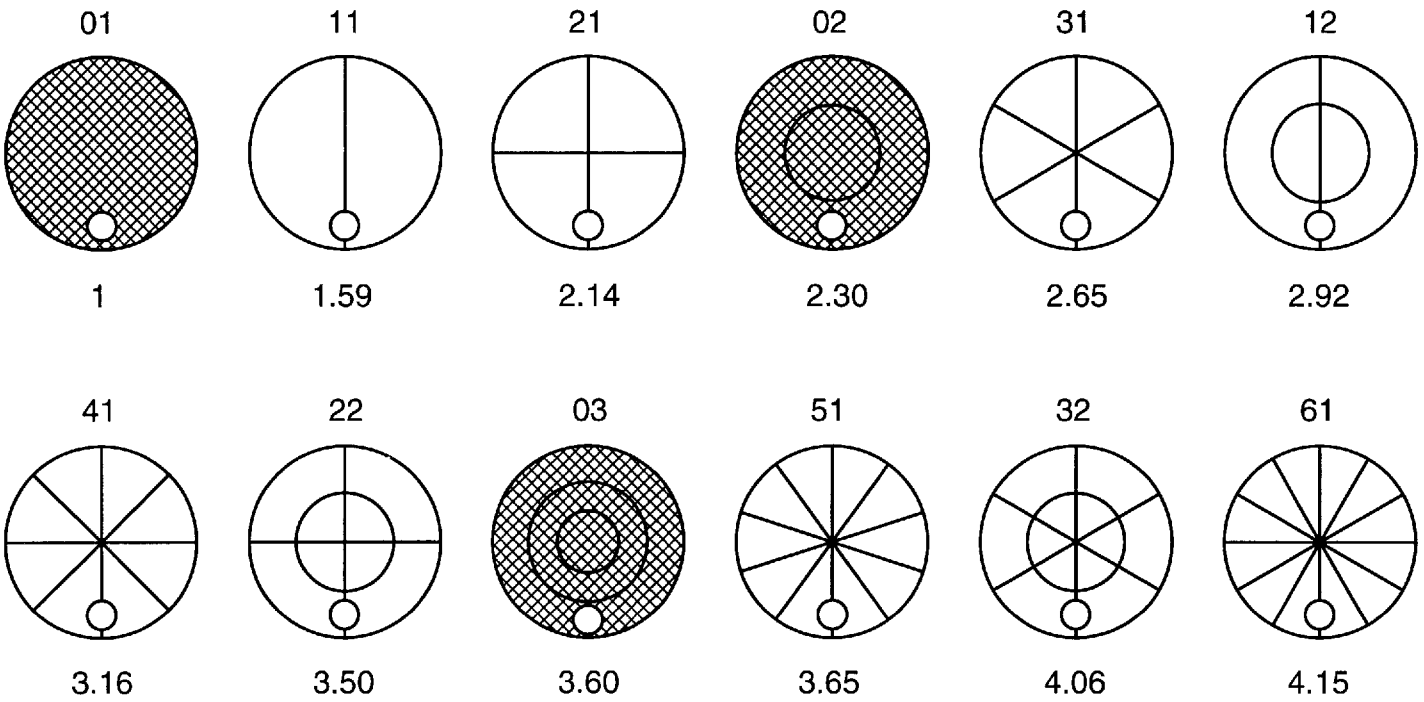
FIG. 2 is a diagrammatic illustration of the twelve normal modes of vibration of a circular percussion membrane similar to that illustrated at FIG. 1 but now having a singular point of muting contact upon the percussion membrane.

One of the unique and innovative design features of the present invention is that it allows one to selectively dampen out particular modes of vibration, thereby controlling not only the loudness, but also the overall character of the sound. In this regard, FIG. 2. illustrates the twelve normal modes of vibration of an ideal circular drum head or membrane, similar to that illustrated at FIG. 1, but now having a single drum moot point of contact upon the membrane (illustrated by small white circular contact point). The effect of the single contact drum mute on the vibration of the membrane is simply to foreclose a node of vibration (i.e., no vibration) in the area of contact which in of itself does not remove any of the modes of vibration having a radial node (since there is no vibration along the nodal line, the damper contact point has little or no effect on that particular mode of vibration). It will, however, remove modes of vibration whose circular modes do not coincide with the linear position of the damper. In this regard, for a damper applied at the contact position shown in FIG. 2 of the twelve modes shown, only modes (01), (02), and (03), are suppressed because they do not have any nodes coinciding with the position of the damper. All the other modes of vibration are still possible because they have a linear nodal line at the damper.

Figure 3:
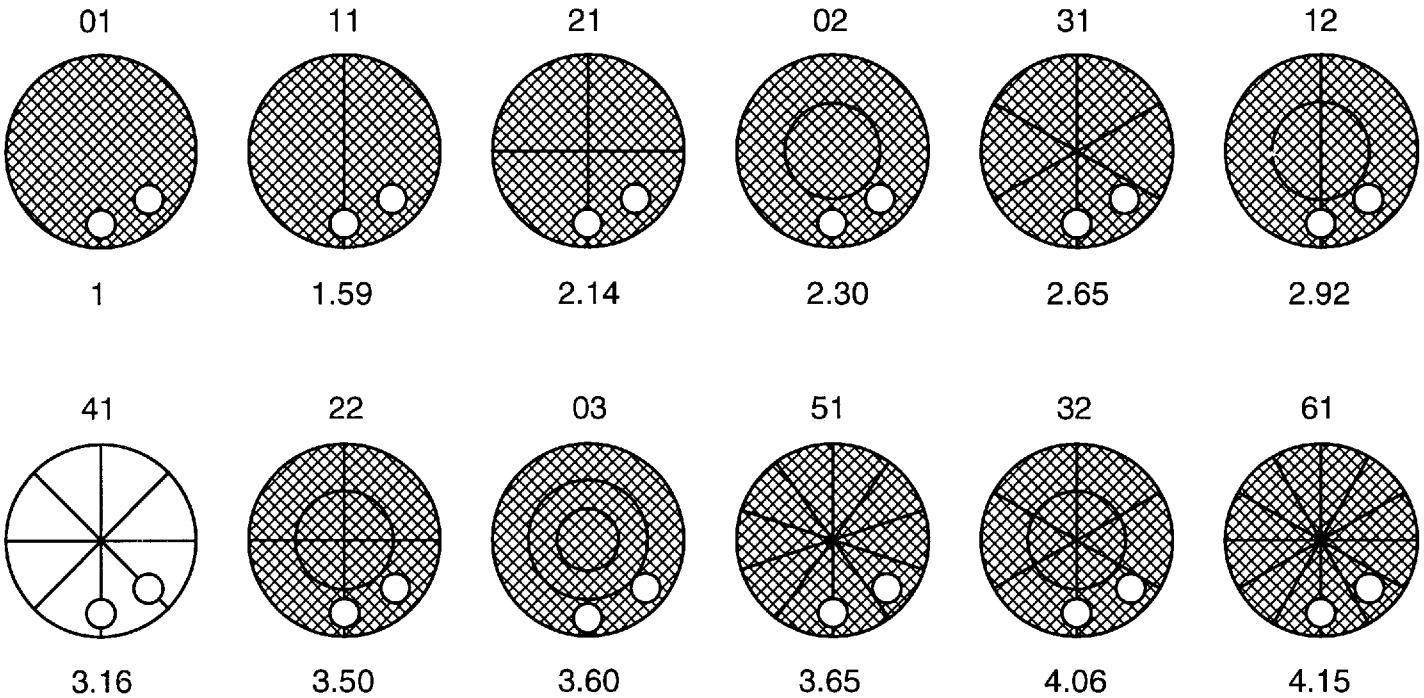
FIG. 3 is a diagrammatic illustration of the twelve normal modes of vibration of a circular drum membrane similar to that illustrated at FIG. 2 but now having two points of muting contact upon the percussion membrane.

In contradistinction, when two separate areas of a drum membrane are contacted by more than one damper, as depicted in FIG. 3, the characteristic sound of the drum is remarkably different and only mode (41) can vibrate because that is the only mode of vibration which has linear nodal lines coincident with the two damper positions. Thus, by judiciously contacting the drum head at a selected second location supplementing a first location (i.e., dampening it in two locations), one can select a particular mode of vibration while simultaneously suppressing most of the rest. The drummer or artist thereby has much greater control of the sound spectrum and the overall characteristic of the percussion sound. The present invention thus takes full advantage of the principles of physics wherein the position, size, pressure, and material of two drum muffling contact points can be individually adjusted so that it is possible to control not only the loudness and duration of the sound but also the harmonic content and thus the whole character of the drum sound.

Figure 5:
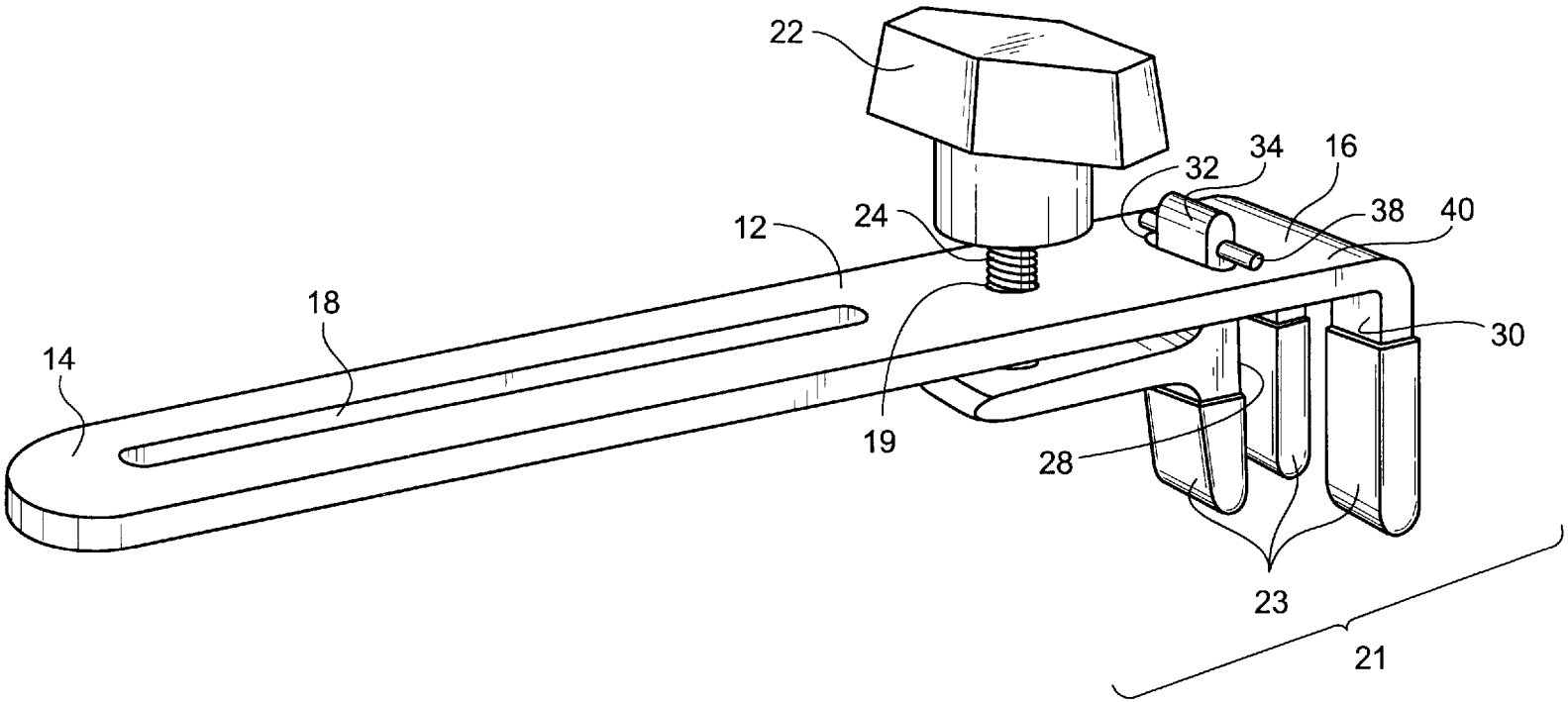
FIG. 5 is a side perspective view of the first arm member of the adjustable sound enhancing muffler device similar to that illustrated at FIG. 4.
Figure 6:
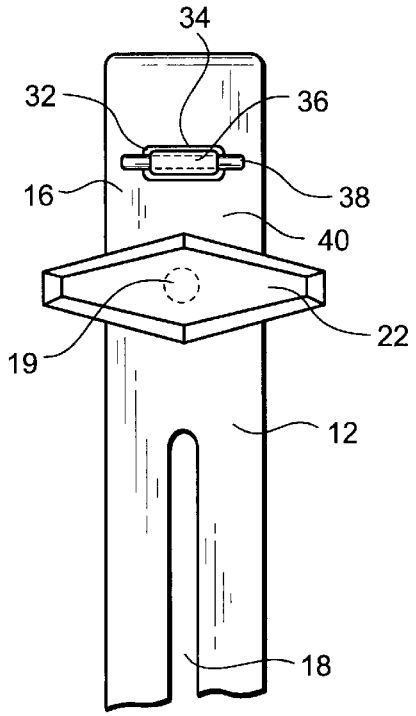
FIG. 6 is a top view of the first arm member of the adjustable sound enhancing muffler device shown at FIG. 5.

Referring again to FIG. 4, there is illustrated a preferred embodiment of the adjustable sound enhancing muffler device 10 of the present invention. Device 10 comprises a first arm member 12 having a distal end 14, a proximal end 16, and a slot 18 extending longitudinally between distal end and proximal end. At proximal end 16 is means for selectively and removably connecting the first arm member 12 to a percussion instrument which comprises proximal end 16 of the first arm member forming clamping structure to clamp the end to a percussion instrument. In this regard, clamping structure 20 includes a turning knob 22 affixed to a screw member 24 which penetrates screw hole 19 to engage the screw member upon a lever arm 26 to thereby force a first clamping surface 28 towards a second clamping surface 30 which is integral or interconnected with the proximal end 16 of the first arm member 12 such that a rim surface of a percussion instrument may be captured between the first clamping surface 28 and the second clamping surface 30 (see FIG. 7). The clamping structure 21 illustrated at FIG. 5 is a preferred means for selectively and removably connecting the first arm member 12 to a percussion instrument, and is identical to clamping structure 20 with the exception of having rubber coating 23 applied to the first clamping surface 28 and the second clamping surface 30 to prevent abrasive contact with a drum head rim. Both the clamping structure 20 of FIG. 4 and the clamping structure 21 of FIG. 5 include a hole 32 in the proximal end 16 of the first arm member 12 which is dimensioned to receive an upper portion 34 of the first clamping surface 28 therein and to permit motion of the upper portion 34 toward distal end 14 when turning knob 22 turns screw member 24 to engage upon lever arm 26 to thereby force first clamping surface 28 proximally towards second clamping surface 30. As also observed at the FIG. 6, upper portion 34 of the first clamping surface 28 has a bore 36 such that the upper portion may be set within hole 32 of the proximal end 16 of the first arm member 12 by means of a pin element 38 inserted into the bore 36 to support and position the upper portion 34 relative upper surface 40 of the proximal end 16.

Other means for selectively and removably connecting the first arm member 12 to a percussion instrument could include wing nut screw and counter brace mechanisms, C-clamp formations, or employment of dual side mount screws.

Figure 8:
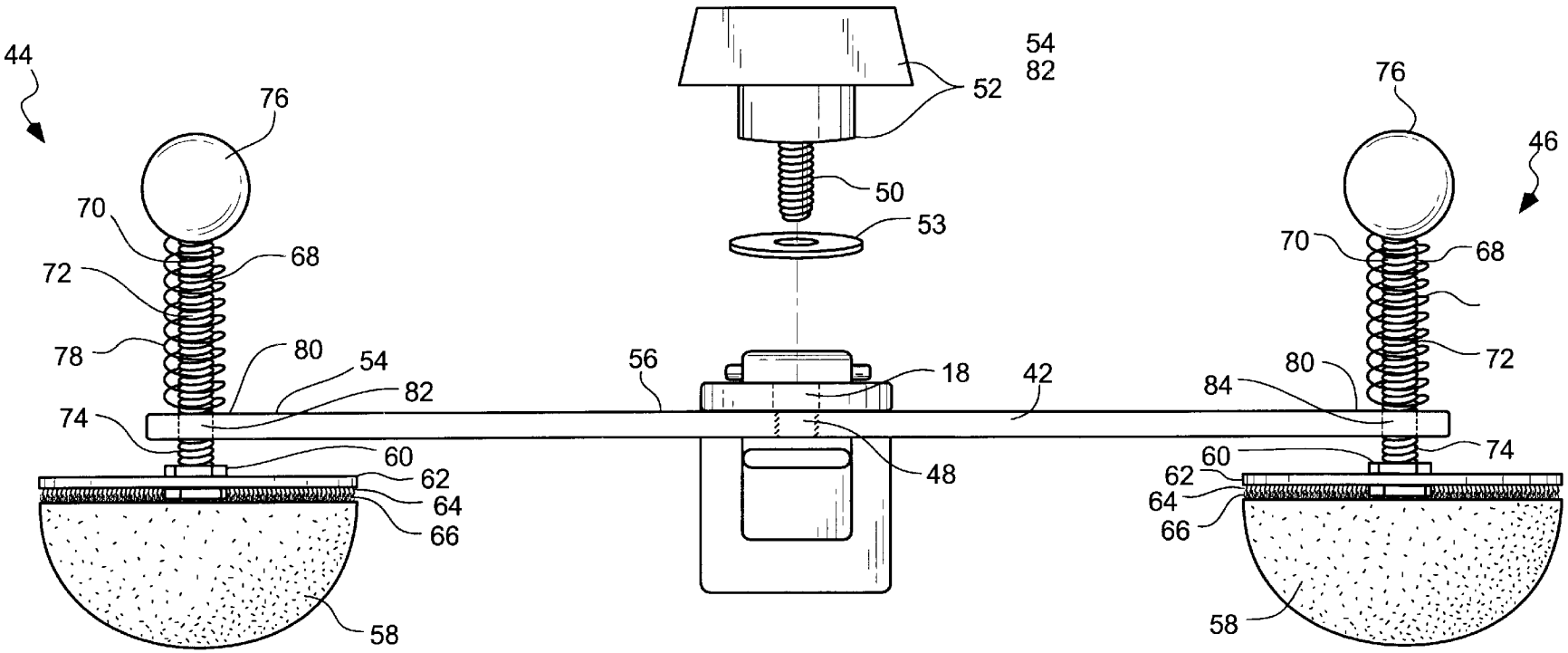
FIG. 8 is a side view, partially exploded, of the second arm member of the adjustable sound enhancing muffler device shown at FIG. 4 and illustrates the pad members attached thereto.
Figure 9:
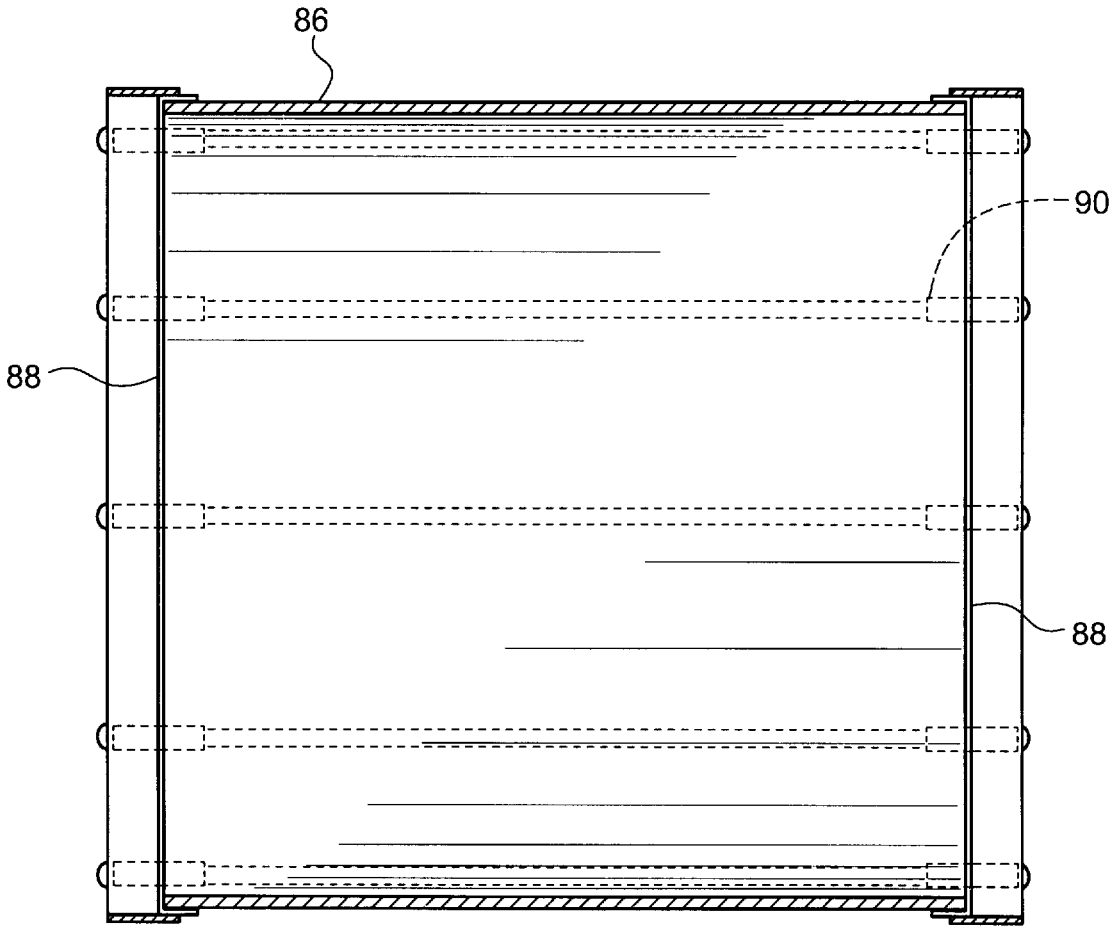
FIG. 9 is a sectional view through the drum shown in FIG. 7 and is taken along line 9—9 of FIG. 7.

The adjustable sound enhancing muffler device 10 of FIG. 4 further includes a second arm member 42 having a plurality of pad members 44 and 46 connected to the second arm member 42. Pad members 44 and 46 each have sound-muffling characteristics when placed into contact with a membrane of a percussion instrument. The device 10 includes means for selectively and removably connecting second arm member 42 to first arm member 12 at a point adjacent slot 18 of the first arm member. In this regard, as best shown at FIG. 8, second arm member 42 has a threaded hole 48 therein which is capable of receiving an arm member connecting thread screw 50. As shown in FIG. 8, arm member connecting thread screw 50 has preferably, but not necessarily, a handle member 52 at an upper end thereof. Alternatively, a wing nut could be employed. Arm member connecting thread screw 50 is inserted through washer 53 and slot 18 of the first arm member 12 to engage the threaded hole 48 of the second arm member 42 and thereby selectively and removably connect the second arm member to the first arm member at a any selected point adjacent the longitudinal slot 18 of the first arm member.

Second arm member 42 has a first end portion 54, a central portion 56, and a second end portion 58 and preferably threaded hole 48 is located at the central portion 56.

The plurality of pad members 44 and 46 connected to second arm member 42 each possess sound muffling characteristics when attached to a membrane of a percussion instrument. In this regard, each pad member contains dampening material 58 which consists preferably of foam, rubber, felt, or a combination thereof as a component of the pad member. Each pad member has a nut 60 mounted within a support surface 62, such as a stainless steel disc. The underside of support surface 62 includes means for fastening the underside surface to dampening material 58. The means for fastening may include a first Velcro surface 64 attached to the underside of support surface 62 for cooperative mating with a second Velcro surface 66 attached atop dampening material 58. This fastening means is preferred such that various size and shapes of dampening material 58 of the pad members may be interchanged with second arm member 42. In this regard, pad members 44 and 46 are illustrated as being generally cylindrical in character yet different pad members may be devised to cooperate with the fastening means at the underside of support surface 62 to provide differing shape pad members or pad members of differing dampening material composition or to replace worn pad members.

The adjustable sound enhancing muffler device 10 also includes tensioning means to place the plurality of pad members 44 and 46 in a set contact of adjustable tension with a membrane of a percussion instrument. The tensioning means includes pad member threaded screw 68 having an upper end 70, a stem portion 72, and a lower end 74. A handle member 76 is provided to the upper end of pad member connecting threaded screw 68 and a tension spring 78 surrounds the stem portion 72 between the handle member 76 and upper surface 80 of second arm member 42. Second arm member 42 has a plurality of threaded bores 82 and 84 corresponding to the plurality of threaded pad members 44 and 46 dimensioned to receive pad connecting thread screw 68. The lower end 72 of pad connecting thread screw 68 is received into nut 60 of the corresponding pad member and engage the same. Since tension spring 78 is set between handle member 76 of pad member connecting thread screw 68 and the upper surface 80 of the second arm member 42 the tensioning means contributes to the weight of the plurality of pad members 44 and 46 upon a membrane of a percussion instrument to thereby contribute to a reduction in the vibratory motion of the membrane and minimize or prevent any shifting movement of the pad members relative the membrane.

Figure 7:
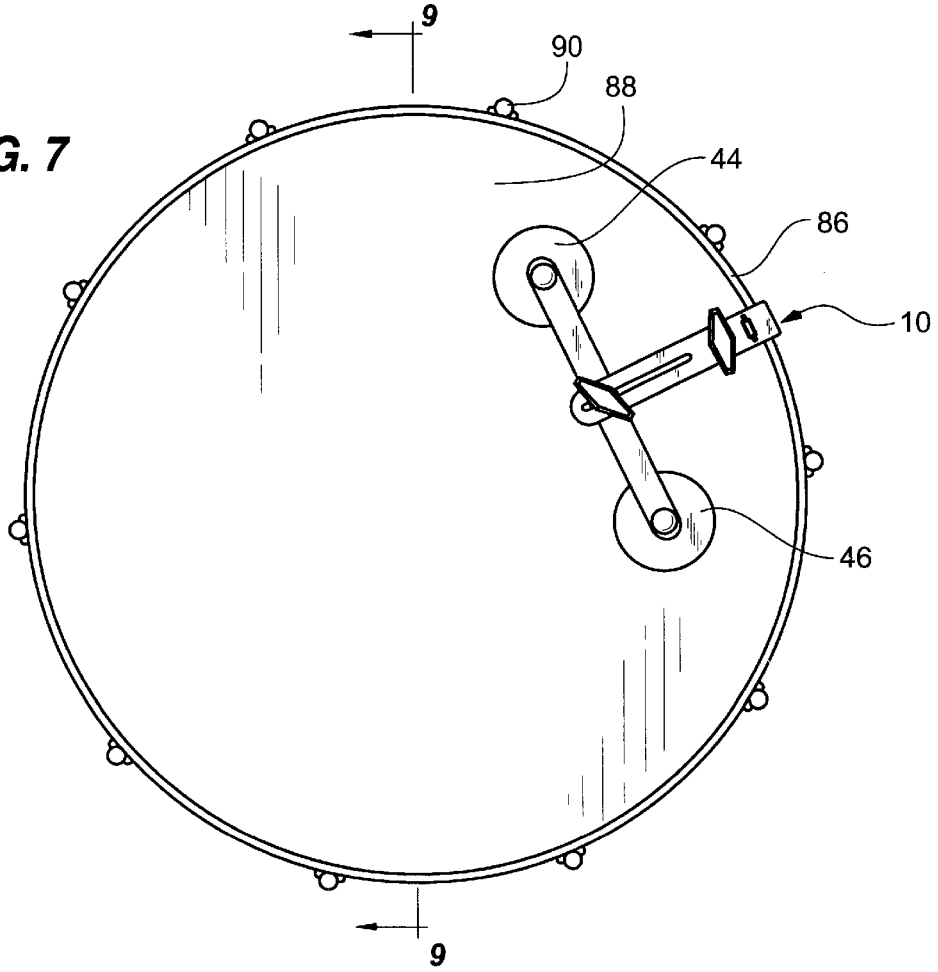
FIG. 7 is a top view of an adjustable sound enhancing muffler device according to the present invention mounted upon a drum.

FIG. 7 illustrates the adjustable sound enhancing muffler device 10 of the present invention mounted via its heretofore described clamping structure to a selected position along the circumference of drum head rim 86 so as to engage pad members 44 and 46 at a selected position upon drum membrane 88 of percussion instrument 90.

The first and second arm members of the adjustable sound enhancing muffler device are preferably fabricated of steel and may be of a varying lengths to suit varying diameters of drum membranes.

It is believed that the adjustable sound enhancing muffler device of the present invention and its numerous attendant advantages will be fully understood from the foregoing description, and that changes may be made in form, construction, and arrangement of the several parts thereof without departing from the spirit or scope of the invention, or sacrificing any of the attendant advantages. The structures herein disclosed are preferred embodiments for the purpose of illustrating the invention. Accordingly, the scope of the invention is only to be limited as necessitated by the accompanying claims.

We claim:

1. An adjustable sound enhancing muffler device for reducing undesirable overtones and ringing when a percussion instrument which has two membranes and to which the device is affixed is struck, said device comprising:

a first arm member having a distal end and a proximal end, mounting means for selectively and removably connecting said first arm member to a percussion instrument, a second arm member for sliding movement and rotational movement on said first arm, two pad members only connected to said second arm member, each pad member having sound-muffling characteristics and being positioned to contact one of the membranes of the percussion instrument for controlling the character or tone of the sound from the percussion instrument as well as for muffling sound from the percussion instrument, means for selectively and removably connecting said second arm member to said first arm member with releasable locking means which are movable along at least a part of the length of said first arm member, which permits rotation of said second arm relative to said first arm and which are lockable to said first arm for placing said pads in one of a plurality of positions relative to the one of the membranes of the percussion instrument so that said pads and particularly the adjusted positions thereof relative to the one of the membranes can control the character or tone of the sound desired and means for urging each of said pad members into contact with the one of the membranes of the percussion instrument.

2. In combination, the device of claim 1 connected to a percussion instrument.

3. The device of claim 1 wherein said mounting means for selectively and removably connecting said first arm member to a percussion instrument comprises a clamping structure at said proximal end of said first arm member for clamping said proximal end to a percussion instrument.

4. The device of claim 3 wherein said clamping structure includes a downwardly extending end flange having a first clamping surface, a pivot member having a second clamping surface and being pivotally mounted to said first arm member and a turning knob affixed to a top of a screw member for enabling rotation of said screw member which is mounted in said first arm member and which has a lower end positioned to engage said pivot member thereby to force said second clamping surface of said pivot member toward said first clamping surface thereby to capture between said clamping surfaces a rim of the percussion instrument.

5. The device of claim 4 wherein said first clamping surface and said second clamping surface have a coating thereon.

6. The device of claim 4 wherein said pivot member includes an upper portion opposed to a lower portion, said upper portion having a bore, and said end of said first arm member has a hole therein to receive said upper portion of said pivot member, said upper portion of said pivot member being set within said hole by means of a pin element inserted into said bore of said upper portion of said pivot member.

7. The device of claim 1 wherein said releasable locking means for releasably locking said second arm member to said first arm member includes an elongate slot in said first arm member, said slot extending from an area near said proximal end to an area near said distal end in said first arm member, a threaded screw received through said slot and received in a threaded hole in said second arm member, and said threaded screw being inserted through said slot of said first arm member to engage in said threaded hole and a gripping member on said threaded screw for facilitating threaded clamping of said second arm member to said first arm member at any desired position along the length of said slot in said first arm member and at any desired rotated position of said second arm member relative to said first arm member dependent upon the character or tone of the sound desired.

8. The device of claim 7 wherein said gripping member is a handle member at an end of said threaded screw.

9. The device of claim 7 wherein said second arm member has a first end portion, a central portion, and a second end portion, and said threaded hole is located in said central portion.

10. The device of claim 1 wherein said means for urging each of said pad members into contact with the one membrane of the percussion instrument comprises a threaded screw connected to each pad member, said second arm member having two threaded holes therein, each threaded screw being threadably received in one of said threaded holes and being rotatable therein for urging said pad member against the one membrane.

11. The device of claim 10 wherein each of said threaded screws for each pad member includes a threaded nut.

12. The device of claim 10 wherein each pad member connecting threaded screw has an upper end, a stem portion, and a lower end, and includes a handle member at said upper end and a tension spring surrounding said stem portion between said handle member and said lower end.

13. The device of claim 11 wherein each pad member connecting threaded screw is engaged in said threaded nut to contribute to the weight of said two pad members upon the one membrane of the percussion instrument thereby contributing to a reduction in the vibratory motion of the one membrane and minimizing any shifting movement of said pad members relative to the one membrane.

14. The device of claim 11 wherein each pad member further includes a support member having an underside and means for fastening said underside of said support member to a dampening material.

15. The device of claim 14 wherein said fastening means comprises a first hoop or loop surface cooperative with a second loop or hook surface attached to said dampening material.

16. The device of claim 14 wherein said dampening material comprises foam, rubber, felt, or a combination thereof.

17. The device of claim 1 wherein said locking means comprises a threaded bolt, an elongate slot in said first arm member, a hole in said second arm member for receiving said bolt and means for threadably locking said bolt to said first and second arm members at a desired position along the length of said first arm member and at a desired rotated position of said second arm member relative to said first arm member.

* * * * *

UNITED STATES PATENT AND TRADEMARK OFFICE

CERTIFICATE OF CORRECTION

PATENT NO. : 5,877,440
DATED : March 2, 1999
INVENTOR(S) : Gary Chaffe and Wolfgang Rueckner It is certified that error appears in the above-indentified patent and that said Letters Patent is hereby corrected as shown below:

On the Title Page, In the Title, delete "BACKGROUND OF THE INVENTION";
Column 01, lines 3-4, delete "BACKGROUND OF THE INVENTION".

Signed and Sealed this

Twenty-eighth Day of September, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,877,440
DATED : March 2, 1999
INVENTOR(S) : Gary Chaffe and Wolfgang Rueckner It is certified that error appears in the above-indentified patent and that said Letters Patent is hereby corrected as shown below:

On the Title Page, Inventors name "Ruckner" should be --Rueckner--;

On the Title Page, In the Title, delete "BACKGROUND OF THE INVENTION";

Column 1, lines 3-4 delete "BACKGROUND OF THE INVENTION".

Signed and Sealed this
Twenty-fifth Day of January, 2000

*Attest:*

*Attesting Officer*

*Acting Commissioner of Patents and Trademarks*